US009042742B2

(12) United States Patent
Yoshimura et al.

(10) Patent No.: US 9,042,742 B2
(45) Date of Patent: May 26, 2015

(54) IMAGE FORMING APPARATUS AND IMAGE FORMING METHOD

(71) Applicant: Konica Minolta, Inc., Tokyo (JP)

(72) Inventors: Kazutoshi Yoshimura, Tokyo (JP); Katsunori Takahashi, Tokyo (JP); Hiroyuki Watanabe, Tokyo (JP); Kenichi Hayashi, Tokyo (JP); Keigo Ogura, Tokyo (JP); Takahiro Yokoya, Tokyo (JP); Kenji Tamaki, Saitama (JP)

(73) Assignee: KONICA MINOLTA, INC., Tokyo (JP)

( * ) Notice: Subject to any disclaimer, the term of this patent is extended or adjusted under 35 U.S.C. 154(b) by 23 days.

(21) Appl. No.: 14/084,798

(22) Filed: Nov. 20, 2013

(65) Prior Publication Data

US 2014/0140710 A1 May 22, 2014

(30) Foreign Application Priority Data

Nov. 21, 2012 (JP) ..... 2012-255232

(51) Int. Cl.
*G03G 15/00* (2006.01)
*G03G 15/20* (2006.01)

(52) U.S. Cl.
CPC ..... *G03G 15/2028* (2013.01); *G03G 15/6511* (2013.01)

(58) Field of Classification Search
CPC ..... G03G 15/5062; G03G 15/5075; G03G 15/2079
USPC ..... 399/9, 8, 11, 12, 18
See application file for complete search history.

(56) References Cited

U.S. PATENT DOCUMENTS

2003/0059221 A1* 3/2003 Funahashi ..... 399/8
2007/0228639 A1* 10/2007 Matsumoto et al. ..... 271/97
2010/0020361 A1* 1/2010 Kim et al. ..... 358/406

FOREIGN PATENT DOCUMENTS

JP 2007-276890 A 10/2007

OTHER PUBLICATIONS

Notification of Rejection Reasons dated Dec. 2, 2014 for corresponding Japanese Patent Application No. 2012-255232 and English translation.

* cited by examiner

*Primary Examiner* — Rochelle-Ann J Blackman
(74) *Attorney, Agent, or Firm* — Lucas & Mercanti, LLP

(57) ABSTRACT

An image forming apparatus receives setting of an object to be adjusted, on an adjustment object selection screen when selecting an adjustment mode. After the object to be adjusted is set, camera(s) photograph(s) the object to be adjusted so that the image forming apparatus obtains photographed data of current object to be adjusted. Next, the apparatus searches photographed data of the object to be adjusted in the ideal state thereof from the database. Name of the object to be adjusted and related information in the photographed data agree with those of the photographed data of current object to be adjusted. The higher ranked related information is preferentially searched and it is determined whether or not pieces of the higher ranked related information thus preferentially searched agree with each other.

9 Claims, 9 Drawing Sheets

FIG.4

DB1

| No. | OBJECT TO BE ADJUSTED (PHOTOGRAPHED DATA Ia) | RELATED DATA | | | | | | | | | |
|---|---|---|---|---|---|---|---|---|---|---|---|
| | | SPECIES OF SHEET OF PAPER | SHEET SIZE | PAPER WEIGHT | COLOR | ORIENTATION PROFILE OF FIBERS IN SHHET OF PAPER | TRAY | TEMPE-RATURE | HUMIDITY | PRINTING RATE | *** |
| 1 | AIR SEPARATION IN TRAY | PLAIN PAPER | A4 | 62 | WHITE | VERTICAL | 2 | 20 | 50 | 3 | *** |
| 2 | AIR SEPARATION IN TRAY | THICK PAPER | POST CARD | 300 | WHITE | VERTICAL | 4 | 20 | 50 | 2 | *** |
| 3 | LOOP IN REGISTRATION ROLLERS | COATED PAPER | A3 | 350 | WHITE | HORIZONTAL | 4 | 20 | 50 | 50 | *** |
| 4 | AIR DETACHMENT IN FIXING PORTION | THIN PAPER | A3 | 42 | WHITE | HORIZONTAL | 1 | 20 | 50 | 20 | *** |
| 5 | AIR SEPARATION IN TRAY | THICK PAPER | A3 | 350 | RED | VERTICAL | 3 | 27 | 50 | 10 | *** |
| 6 | AIR SEPARATION IN TRAY | PAPER FOR OVER-PRINTING | A3 | 250 | BLUE | VERTICAL | 4 | 20 | 50 | 2 | *** |
| *** | *** | *** | *** | *** | *** | *** | *** | *** | *** | *** | *** |

FIG.5

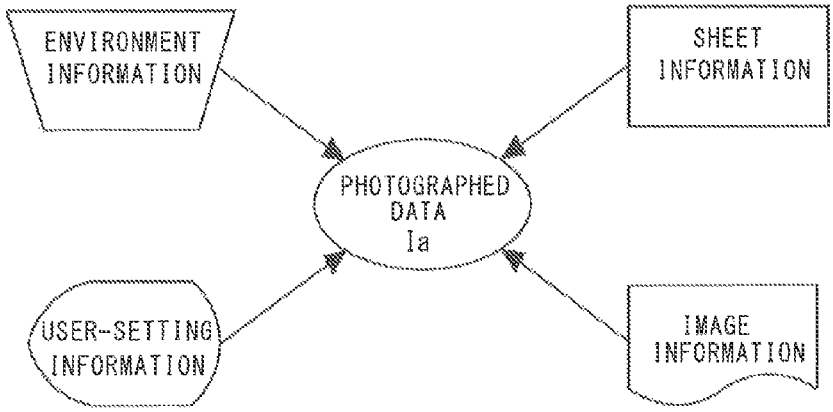

FIG.6

DB1

| No. | OBJECT TO BE ADJUSTED (PHOTOGRAPHED DATA Ia) | RELATED DATA | | | | | | | | |
|---|---|---|---|---|---|---|---|---|---|---|
| | | SPECIES OF SHEET OF PAPER | SHEET SIZE | PAPER WEIGHT | COLOR | ORIENTATION PROFILE OF FIBERS IN SHHET OF PAPER | STIFF-NESS | TEMPE-RATURE | PRINTING RATE | *** |
| 1 | AIR SEPARATION IN TRAY | A | B | A | D | B | B | B | D | *** |
| 2 | LOOP IN REGISTRATION ROLLERS | A | C | A | D | A | A | B | D | *** |
| 3 | AIR DETACHMENT IN FIXING PORTION | A | C | A | D | A | B | C | A | *** |
| 4 | SHEET FLOATING IN TRANSFER UNIT | A | A | A | D | D | D | B | D | *** |
| N | *** | *** | *** | *** | *** | *** | *** | *** | *** | *** |

FIG.7

DB1

| No. | OBJECT TO BE ADJUSTED | RELATED INFORMATION TO BE PREFERENTIALLY SEARCHED | | | |
|---|---|---|---|---|---|
| 1 | AIR SEPARATION IN TRAY | SPECIES OF SHEET OF PAPER | PAPER WEIGHT | | |
| 2 | LOOP IN REGISTRATION ROLLERS | SPECIES OF SHEET OF PAPER | PAPER WEIGHT | ORIENTATION PROFILE OF FIBERS IN SHHET OF PAPER | STIFFNESS |
| 3 | AIR DETACHMENT IN FIXING PORTION | SPECIES OF SHEET OF PAPER | PAPER WEIGHT | ORIENTATION PROFILE OF FIBERS IN SHHET OF PAPER | PRINTING RATE |
| 4 | SHEET FLOATING IN TRANSFER UNIT | SPECIES OF SHEET OF PAPER | PAPER WEIGHT | | SHEET SIZE |

ORIENTATION

FIG.11A

| No. | OBJECT TO BE ADJUSTED (PHOTOGRAPHED DATA 1b) | RELATED DATA | | | | | | |
|---|---|---|---|---|---|---|---|---|
| | | SPECIES OF SHEET OF PAPER | PAPER WEIGHT | SHEET SIZE | ORIENTATION PROFILE OF FIBERS IN SHHET OF PAPER | TEMPE-RATURE | COLOR | PRINTING RATE |
| 1 | AIR SEPARATION IN TRAY | THICK PAPER | 350 | A 3 | VERTICAL | 25 | WHITE | 5 |

FIG.11B

| No. | OBJECT TO BE ADJUSTED (PHOTOGRAPHED DATA 1a) | RELATED DATA | | | | | | |
|---|---|---|---|---|---|---|---|---|
| | | SPECIES OF SHEET OF PAPER | PAPER WEIGHT | SHEET SIZE | ORIENTATION PROFILE OF FIBERS IN SHHET OF PAPER | TEMPE-RATURE | COLOR | PRINTING RATE |
| 1 | AIR SEPARATION IN TRAY | PLAIN PAPER | 62 | A 3 | VERTICAL | 20 | WHITE | 3 |
| 2 | AIR SEPARATION IN TRAY | THICK PAPER | 300 | POST CARD | VERTICAL | 20 | WHITE | 2 |
| 5 | AIR SEPARATION IN TRAY | THICK PAPER | 350 | A 3 | VERTICAL | 27 | RED | 10 |

IMAGE FORMING APPARATUS AND IMAGE FORMING METHOD

CROSS REFERENCE TO RELATED APPLICATION

The present, invention contains subject matter related to Japanese Patent Application JP 2012-255232 filed in the Japanese Patent Office on Nov. 21, 2012, the entire contents of which being incorporated herein by reference.

BACKGROUND OF THE INVENTION

1. Field of the Invention

The present invention relates to an image forming apparatus and an image forming method that form an image on a sheet of paper.

2. Description of Related Art

In an image forming apparatus, any predetermined adjustments have been performed before it has released so that a floating or separating condition of sheets of paper in a feeding tray, a loop-shaped condition of the sheet of paper in registration rollers, a detached, condition of the sheet of paper in a transfer unit and a fixing portion or the like may be made optimal. Further, even after the apparatus has been forwarded, fixed adjustments have been conducted because there may be a case where a previously set value has been out of place at the optimal value based on a change over time of the image forming apparatus and/or a variation of parts thereof.

The majority of adjustment of the conditions in the apparatus such as the floating condition of the sheets of paper in the feeding tray has relied on experience and/or intuition of a service man so that it has taken an excessive period of time to adjust the apparatus. On the adjustment, many waste sheets have generated. In recent years, due to the enlargement of the image forming apparatus, the extension of capable media and the like, portions to be adjusted have increased in the image forming apparatus and contents of the adjustment have complicated. This causes a workload to be increased on the service man and productivity to be reduced.

In order to save labor based on reduction of the adjustment time and to reduce downtime, a method of detecting the condition of each device by detection means such as a sensor and adjusting each condition thereof by controlling each device based on this detection result has been proposed. For example, Japanese Patent Application Publication No. 2007-276890 has disclosed an image forming apparatus having an adjustment mode for adjusting a number of revolutions of a separation fan blowing air for separating sheets of paper in a tray so that the number of revolutions of the separation fan which has been detected by a detection sensor for detecting the number of revolutions has stood within a previously set target value range.

SUMMARY OF THE INVENTION

However, the image forming apparatus, which has been disclosed in Japanese Patent Application Publication No. 2007-276890, has a configuration such that the number of revolutions of the separation fan is adjusted by only the detection result of the detection sensor for the number of revolutions so that it is difficult to check how to separate sheets of paper realty by the separate fan. Accordingly, it is difficult to grasp each condition accurately and when a fault occurs, it is also difficult to identify a cause or the like thereof.

In order to grasp a condition such as that in the separation accurately, another method for mounting cameras on an image forming apparatus has been mentioned. In this method, many items of photographed data in which an apparatus is photographed under a normal condition thereof are stored in database and items of photographed data in which a current condition of a portion to be adjusted in the apparatus is photographed are obtained from the cameras. An item of ideal photographed data corresponding to the item of photographed data in which the current condition of the portion to be adjusted in the apparatus is photographed is searched from the database so that by comparing the items of photographed data in which the current condition of the portion to be adjusted in the apparatus is photographed with the item of ideal photographed data, the current condition of the portion to be adjusted in the apparatus is adjusted.

In the adjusting method which uses the cameras, however, a control of conveying the sheet of paper and a control of forming an image are performed on the basis of combinations of many pieces of related information such as species of sheet of paper, sheet sizes, paper weights, orientation profiles of fibers in the sheet of paper, colors and the like in the current image forming apparatus such as a copier. Accordingly, in order to utilize the photographed, data as the database, many pieces of related information are stored with them being related to the photographed data and the combinations of many pieces of related information are prepared. However, when items of the photographed data, all the items of related information of which agree with pieces of desired photographed information, are searched from the database, there are an infinite number of the combinations of the related information. This is not a realistic idea because of enormous numbers of items of data.

This invention addresses the above-mentioned issues and has an object to provide the image forming apparatus and an image forming method that saves labor based on reduction of the adjustment time and reduces downtime.

To achieve the above-mentioned object, an image forming apparatus contains a photographing portion that photographs an object to be adjusted in she image forming apparatus and obtains first photographed information with a plurality of pieces of related information with reference to image forming being related to the first photographed information, and a control portion that is configured to search second photographed information indicating an ideal condition for each object to be adjusted, related information of the second photographed information agreeing with the related information of the first photographed information obtained by the photographing portion, from a database in which the second photographed information, is stored with a plurality of pieces of ranked related information with reference to the image forming being related to the second photographed information, wherein the control portion preferentially searches the higher ranked related information among the plurality of pieces of the ranked related information that is related to the second photographed information at a moment of searching the second photographed information.

It is desirable to provide the image forming apparatus wherein when the related information includes a numerical value, the control portion searches the second photographed information with the numerical value having a predetermined scope thereof.

It is desirable to provide the image forming apparatus further containing a display portion which displays on a screen a first image based on the first photographed information photographed by the photographing portion and a second image based on the second photographed information searched from the database by the control portion.

It is desirable to provide the image forming apparatus wherein the control portion controls the display portion to display on the screen thereof an adjustment image for adjusting an object to be adjusted corresponding to the first image.

Further, to achieve the above-mentioned object, an image forming method contains a first step of photographing an object to be adjusted in an image forming apparatus and obtaining first photographed information with a plurality of pieces of related information with reference to image forming being related to the first photographed information, and a second step of searching second photographed reformation indicating an ideal condition for each object to be adjusted, related information of the second photographed information agreeing with the related information of the first photographed information obtained by the photographing portion, from a database in which the second photographed, information is stored with a plurality of pieces of ranked related information with reference to the image forming being related to the second photographed information, wherein, the higher ranked related information is preferentially searched among the plurality of pieces of the ranked related information, that is related to the second photographed information at a moment of searching the second photographed information in the second step.

In this application, the object to be adjusted includes a floating or separating condition of sheets of paper in a feeding tray, a loop-shaped condition of the sheet of paper in registration rollers, a detached condition of the sheet of paper in a transfer unit and a fixing portion or the like. The first photographed information contains the photographed data indicating to a current condition of the object to be adjusted. The second photographed information contains the photographed data indicating to the ideal (normal) condition of the object to be adjusted. The agreement in the search includes a case where both agree with each other in all the contents of the related information and a case where when the related information relates to numerical number, it is considered as the agreement if it stands within, a fixed range including the numerical number.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

BRIEF DESCRIPTION OF THE DRAWINGS

FIG. 4 is a table showing a configuration example of a database;

FIG. 5 is a diagram showing a configuration example of photographed data to be stored on the database;

FIG. 6 is a table showing pieces of ranked related information;

FIG. 7 is a table showing a configuration example of a database in which pieces of the highest ranked related information are extracted;

FIG. 11A is a table showing photographed data of the current object to be adjusted in the adjustment mode and FIG. 11B is a table showing photographed data of the object to be adjusted in the ideal, condition thereof in the adjustment mode.

DESCRIPTION OF THE PREFERRED EMBODIMENTS

The following will describe embodiments of an image forming apparatus and an image forming method relating to the inventions with, reference to drawings.

[Configuration Example of Image Forming Apparatus]

The following will describe a configuration of an embodiment of the image forming apparatus 100 according to the invention. The image forming apparatus 100 has an adjustment mode for adjusting a separation condition of sheets of paper P or the like. The image forming apparatus 100 searches photographed data Ia (second photographed information) indicating an ideal condition of an object to be adjusted, which corresponds to the photographed data Ib (first photographed information) of the current object to be adjusted, in this moment, the image forming apparatus 100 preferentially searches the higher ranked related information, among the plurality of pieces of the ranked related information, which are related to the first image information, in a database DB1 or DB2.

Figure 1:
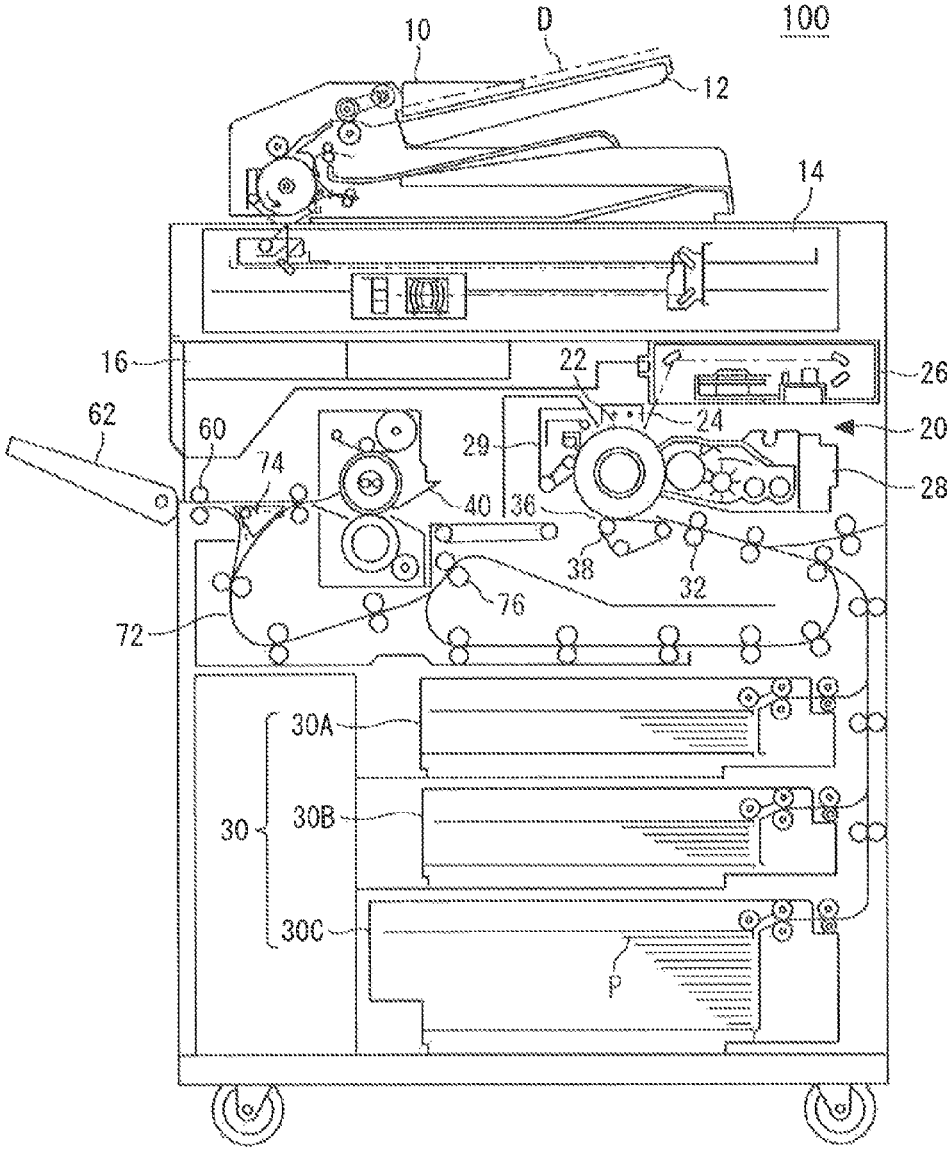
FIG. 1 is a diagram showing a configuration example of an image forming apparatus according to an embodiment of this invention.
Figure 2:
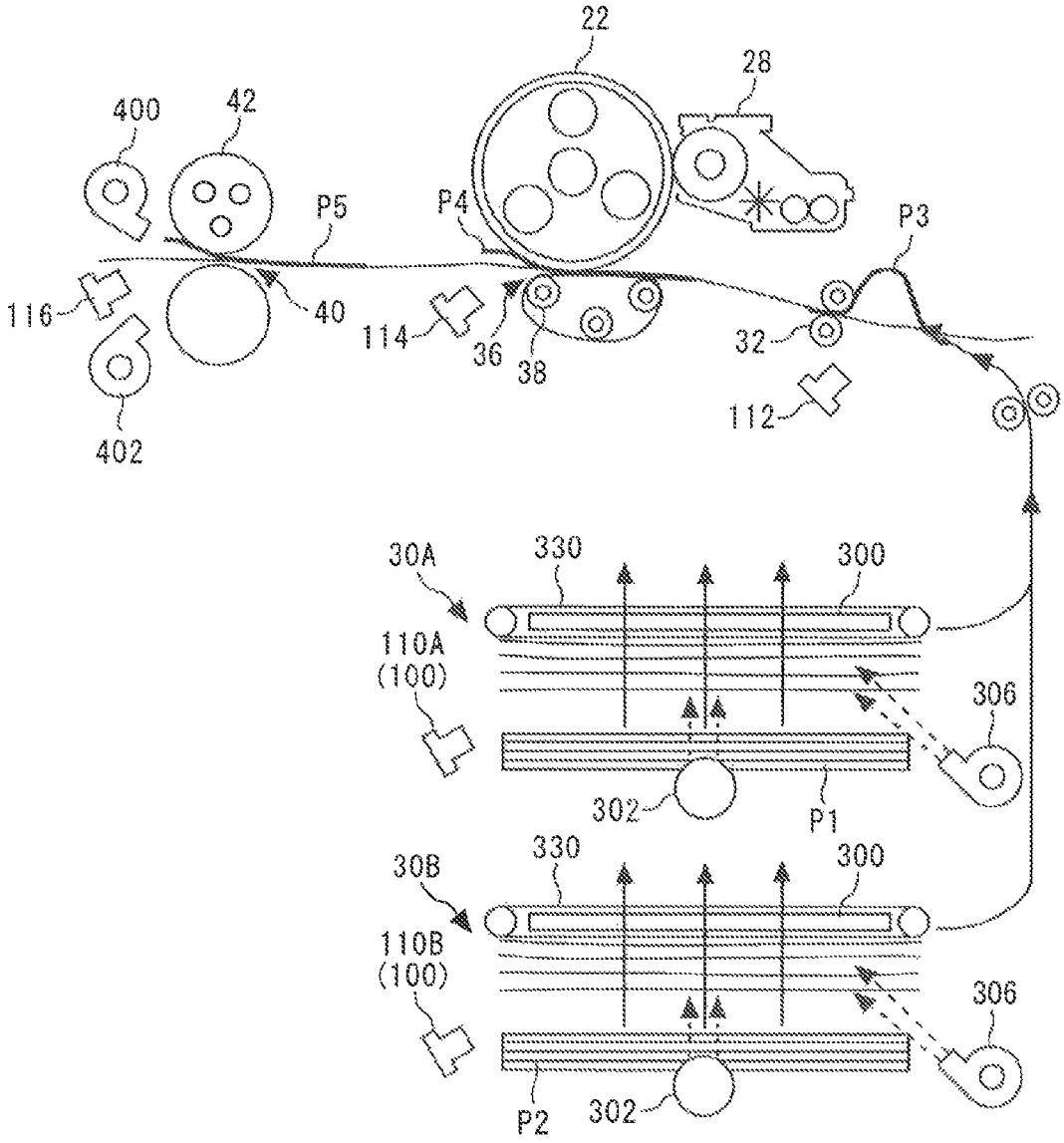
FIG. 2 is a diagram showing a setting example of cameras which photograph conditions of sheet(s) of paper in the image forming apparatus.

FIG. 1 shows a configuration example of the image forming apparatus 100 for forming a monochrome image according to an embodiment of this invention. FIG. 2 schematically shows a setting example of cameras 110A and the like set in the image forming apparatus 100 shown in FIG. 1. The image forming apparatus 100 forms an image on the sheet of paper P using an electrographic method. The image forming apparatus 100 contains a document feeder 10, a reading portion 14, an image forming portion 20, a sheet feeder 30 and a fixing portion 40.

A document D set on a document feeding tray 12 in the document feeder 10 is transported to the reading portion 14. The reading portion 14 optically reads an image on the document D and converts information relative to the read image into an analog electric signal thereof. The reading portion 14 then converts the analog electric signal into a digital signal. The reading portion 14 outputs the converted digital signal to an image processing portion 16 as image data. The image processing portion 16 performs any analog processing, A/D conversion, shading correction, image compression processing and the like on the photographed data. The image processing portion 16 then outputs an image signal to the image forming portion 20.

The image forming portion 20 contains a photosensitive drum 22, a charging part 24, an exposing part (optical writing part) 26, a developing part 23 and a cleaning part 29. The charging part 24 charges a static charge uniformly around a surface of the photosensitive drum 22. The exposing part 26 scans the surface of the photosensitive drum 22 using laser beam based on the image signal output from, the image forming portion 16 to form a latent image on the surface of the photosensitive drum 22. The developing part 28 develops the latent image formed on the surface of the photosensitive drum 22 to form a toner image.

The sheet feeder 30 is provided with plural feeding trays 30A, 30B and 30C, which respectively correspond to the sheet sizes such as A3, A4 and the like. As shown in FIG. 2, a forward, end separation fan 306 for separating forward ends of the sheets of paper P is provided at a front side (right side shown in FIG. 2) of the feeding tray 30A. Side separation fans 302 for separating sides of the sheets of paper P are respectively provided at both sides of the feeding tray 30A (only one side separation fan is shown in FIG. 2). An absorption fan 300 for sucking the sheet of paper P which has been separated from a bundle of sheets of paper P by the forward separation fan 306 and the like and transporting the sheet of paper P to a transfer unit 36 is provided at an upper portion of the feeding tray 30A. It is supposed that the separation fan 302 and the like are provided in the feeding trays 30B and 30C, respectively, which is similar to the feeding tray 30A. Predetermined sheets of paper P accommodated in each of the feeding trays 30A, 30B and 30C are picked out one by one by blowing air thereto and they are fed to registration rollers 32.

The registration sensor 32 performs any corrections such as a correction of deviation or the like on the sheet of paper P fed from the sheet feeder 30 and transports the corrected sheet of paper P to the transfer unit 36 at a predetermined timing. The transfer unit 36 is composed of the photosensitive drum 22 and transfer rollers 38 (or a transfer belt) which hold the sheet of paper P between them. The transfer unit 36 transfers the image (toner image) formed on the photosensitive drum 22 onto a surface of the sheet of paper P fed from the registration rollers 32.

The fixing portion 40 fixes the tone image on the sheet of paper P by heating and pressing the sheet of paper P on which the toner image has been formed by the transfer unit 36. As shown in FIG. 2, at the fixing portion 40, a separation fan 400 and a suction fan 402, by which the sheet of paper P sacked to a fixing roller 42 in a moment of fixing processing is detached from the fixing roller 42, are provided. The separation fan 400 is provided at a side of the fixing roller 42 and the suction fan 402 is provided at the opposite side via a sheet-transporting path. Ejection rollers 60 eject the sheet of paper P which has been fixed by the fixing portion 40 onto an ejection tray 62 provided outside.

When forming images on both sides of the sheet of paper P, a transporting path switch part 74 switches transporting paths and the sheet of paper P, on a surface of which an image has been formed, is transported to a sheet inverting portion 72. Sheet inverting rollers 76 inverts (switches back) the sheet of paper P transported to the sheet inverting portion 72 and transports the inverted sheet of paper P to the transfer unit 36 with the sheet of paper P being inverted from the front thereof to the back thereof. The transfer unit 36 forms an image on the back of the sheet of paper P and then the fixing portion 40 fixes the image on. the back of the sheet of paper P. The ejection rollers 60 eject the sheet of paper P onto the ejection tray 62.

It is to be noted that although the image forming apparatus 100 for forming the monochrome image has been described in this embodiment, the invention is not limited thereto. The invention is also applicable to an image forming apparatus for forming a color image. In this case, the image forming apparatus is provided with image forming units for colors of yellow (Y), magenta (M), cyan (C) and black (B), an intermediate transfer belts for forming the color image by laying one color toner image on top of another color toner image and the like.

[Setting Example of Cameras]

The following will describe cameras 110A, 110B, 112, 114 and 116 set in the image forming apparatus 100. As shown, in FIG. 2, the image forming apparatus 100 is provided with the cameras 110A, 110B, 112, 114 and 116 each for photographing an object to be adjusted. The cameras 110A, 110B, 112, 114 and 116 constitute a photographing portion.

The camera 110A is provided in the feeding tray 30A and photographs a separated condition of the sheets of paper P1, a floated (absorbed) condition thereof and the like when activating an absorption and transport mechanism 330 or the like in the feeding tray 30A. The camera 110B is provided in the feeding tray 30B and photographs a separated condition of the sheets of paper P2, a floated (absorbed) condition thereof and the like when, activating an absorption and transport mechanism 330 or the like in the feeding tray 30B. It is supposed that a camera that is similar to the camera 110A is set in the feeding tray 30C shown in FIG. 1.

The camera 112 is set at a surrounding area (near) of the registration rollers 32 and photographs a loop-shaped state of the sheet of paper P3, which is formed by hitting a forward end of the sheet of paper P3 against the registration rollers 32. The camera 114 is set at a surrounding area of the transfer unit 36 and photographs a detached state of the sheet of paper P4 from the photosensitive drum 22 and the transfer rollers 38. The camera 116 is set at a surrounding area of the fixing portion 40 and photographs a detached state of the sheet of paper P5 from the fixing roller 42 constituting the fixing portion 40.

Although plural cameras have been respectively set in the objects to be adjusted, for example, one camera may be used and this camera, is set in the respective objects to be adjusted when adjusting them. The camera 110A and the like may be previously set in the image forming apparatus 110 or they may be gradually set when adjusting the objects.

[Configuration Example of Image Forming Apparatus]

Figure 3:
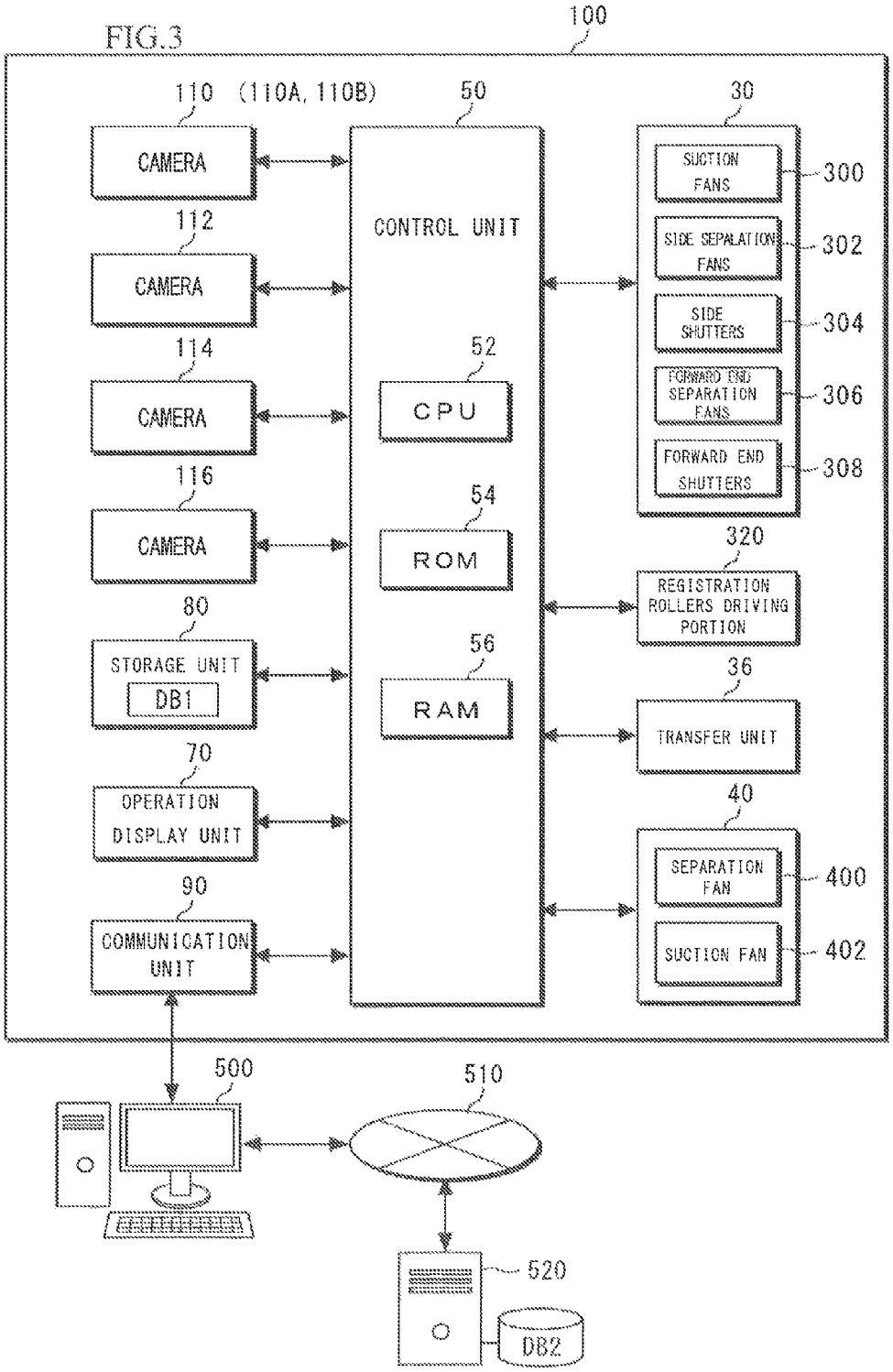
FIG. 3 is a block diagram, showing a configuration example of the image forming apparatus according to the embodiment of this invention.

The following will describe a configuration example of the image forming apparatus 100 according to an embodiment of the invention. FIG. 3 illustrates a configuration example of the image forming system 100. As shown in FIG. 3, the image forming system 100 is provided with a control unit 50 controlling an operation of whole of the image forming apparatus 100. The control unit 50 includes a central processing unit (CPU) 52, a read only memory (ROM) 34 for storing control software and data, a random access memory (RAM) 56 for constituting a work area of CPU 52. CPU 52 performs an image forming process and an adjustment mode for adjusting the floated condition, of the sheet of paper P and the like by reading the software and data out of ROM 54 and extracting them in the RAM 56 to execute the software.

The control unit 50 connects the cameras 110 (110A, 110B), 112, 114 and 116, a storage unit 80, an operation display unit 70, a communication unit 90, the sheet feeder 30, a registration rollers driving portion 320, the transfer unit 35 and the fixing portion 40, respectively. The cameras 110 photograph the floated condition of the sheets of paper P in the feeding trays 30A and 30B when feeding them and supplies photographed (image) data obtained by photographing them to the control unit 50.

The camera 112 photographs the loop-shaped condition of the sheet of paper P3 when correcting the deflection (deviation) of the sheet of paper P3 and supplies the photographed data obtained by photographing it to the control unit 50. The camera 114 photographs the detached state of the sheet of paper P4, on which the image has been transferred, from the photosensitive drum 22 and the transfer rollers 38 and supplies the photographed data obtained by photographing it to the control unit 50. The camera 116 photographs the detached state of the sheet of paper P5, on which the fixing processing has been performed, from the fixing roller 42 constituting the fixing portion 40 and supplies the photographed data obtained by photographing it to the control unit 50. It is to be noted that the photographed data which is photographed by the cameras 110, 112, 114 and 116 may be relative to still photographed data or moving photographed data.

The storage unit 80 is composed of, for example, a non-volatile semiconductor device, a hard disk drive (HDD) and the like. The storage unit 80 temporarily stores the photographed data or the like read in the reading portion 14. The storage unit 80 holds a set of the photographed data Ib which is obtained by photographing the objects to be adjusted by the cameras 110 and the like, and a database DB1 including a set of the photographed data Ia which is obtained by photographing the objects to be adjusted while their normal (stable) conditions, these items of photographed data being used at the moment of adjustment mode. The database DB1 will be described later.

The operation display unit 70 is composed of a positional information input part of a touch panel type and a display part of crystal liquid display or the like, which are combined, into a single unit. The operation display unit 70 displays an operation screen to set any kinds of conditions of image forming processing such as sheet sizes, species of the sheet of paper, paper weight of the sheet of paper P and the like and to set a start of the adjustment mode. The operation display unit 70 receives such conditions of image forming processing input on the operation screen by a user and/or setting of the start of the adjustment mode and supplies them to the control unit 50.

The communication unit 90 is composed of, for example, a serial communication interface and the like. The communication unit 90 is connected, with a computer 500 via local area network (LAN) and performs bidirectional communication of information relative to the image formation and/or the adjustment mode with the computer 500.

The sheet feeder 30 is provided with the absorption fans 300, the side separation fans 302, the side shutters 304, the forward end separation fans 306, and the forward end shutters 308. The absorption fans 300 drive under control of the control unit 50. Each of the absorption fans 300 allows the absorption and transport mechanism 330 (see FIG. 2) to absorb the uppermost sheet of paper P floated on the basis of operations of the side separation fans 302 and the forward end separation fan 306.

The side separation fans 302 drive under control of the control unit 50. Each of the side separation fans 302 separates a bundle of the sheets of paper P set in the sheet feeding portion 30 by blowing air to a side of the bundle of the sheets of paper P and allows the uppermost sheet of paper P to float toward the absorption and transport mechanism 330. The side shutters 304 perform open or close (ON/OFF) operation under control of the control unit 50 to control a start or stop of blowing of air from the side separation fans 302 or to switch a blowing direction of the air out of the side separation fans 302 to either a floated direction thereof or a separation direction thereof.

The forward end separation fans 305 drive under control of the control unit 50. Fact of the forward end separation fans 306 separates a bundle of the sheets of paper P by blowing air to a forward end of the bundle of the sheets of paper P and allows the uppermost sheet of paper P to float toward the absorption and transport mechanism 330. The forward end shutter 308 performs open or close (ON/OFF) operation under control of the control unit 50 to control a start or stop of blowing of air from the forward end separation fans 306 or to switch a blowing direction of the air out of the forward end separation fans 306 to either a floated direction thereof or a separation direction thereof.

The registration rollers driving portion 320 is composed of, for example, a stepping motor. The registration rollers driving portion 320 adjusts an amount of loop of the sheet of paper P formed by hitting the forward end of the sheet of paper P against the registration rollers 32 by rotating the registration rollers 32 in a forward or reverse direction, stopping the registration rollers 32 or changing their operation timings under control of the control unit 50.

The transfer unit 36 changes electricity in the charged photosensitive drum 22, the charged transfer rollers 38 and the like based on the applied variable voltage under control of the control unit 50 to change an attachment of the sheet, of paper P to the photosensitive drum 22, the transfer rollers 38 and the like. This enables the attached sheet of paper P thereto to be detached from the photosensitive drum 22 or the like. This detachment may be accomplished by the change in velocity of the transfer rollers 38 or the belt.

The fixing portion. 40 contains the separation fan 400 and the suction fan 402. The separation fan 400 drives under control of the control unit 50. The separation fan 400 detaches the sheet of paper P from the fixing rollers 42 by blowing the air to the sheets of paper P attached to the fixing roller 42 under the fixing processing of the fixing portion 40.

The suction fan 402 draws air thereinto to suck by negative pressure thereof the sheet of paper P which has been attached to the fixing rollers 42 under the fixing processing of the fixing portion 40. This enables the sheet of paper P to be detached from the fixing rollers 42. Timing or angle of blowing air may be adjusted by providing the separation fans 400 and/or the suction fan 402 with shutter(s) which is (are) similar to the case of the side separation fans 302 or the like in the sheet feeder 30.

The computer 500 is provided with an operation display unit, not shown, which is similar to a case of the image forming apparatus 100. An operation screen for setting the image forming conditions and/or adjustment mode is displayed on the operation display unit. By operating an operation unit on the operation screen, it is possible to input the image forming condition and/or to select, the adjustment mode.

The computer 500 connects a server 320 via a network 510 such as the Internet or the like. The server 520 stores the database DB2 used in a moment of the above-mentioned adjustment mode. The computer 500 may search a set of the photographed data in a moment of the adjustment mode using the database DB2 updated to a set of the newest photographed data Ia by downloading it from the server 520.

[Configuration Example of Database]

The following will describe a configuration example of the database DB1 stored in the storage unit 80 according to an embodiment of the invention. FIG. 4 shows the configuration example of the database DB1. FIG. 5 shows a configuration example of the photographed data Ia to be stored on the database DB1. It is to be noted that the description of the database DB2 stored in the server 520 will be omitted because the database DB2 has the same configuration as that of the database DB1.

As shown in FIGS. 4 and 5, a set of the photographed data Ia obtained by photographing the object, to be adjusted, which stands in a normal or stable state (ideal state), is stored in the database DB1 with the photographed data Ia being related to any related information indicating to the image forming condition when photographing the object. Although only the name of the object to be adjusted is indicated in the database DB1 shown in FIG. 4, it is supposed that the name of the object to be adjusted includes the photographed data Ia obtained by photographing the object by means of each of the cameras. The photographed data la contains any information relative to a shutter speed of the camera, exposure, exposure index and the like in addition to image data. The related information contains sheet information relative to the species of sheet of paper, the sheet sizes, the paper weights, the colors, the orientation profiles of fibers in the sheet of paper and the like when photographing the object, user-setting information relative to a used tray, sheet setting (front surface or back surface) of the sheet of paper, environment information relative to temperature, humidity and the like, and image information when forming the image relative to printing rate and the like, as shown in FIG. 5. It is to be noted that the related information of the photographed data Ib also contains the same information as the related information of photographed data Ia.

For example, as shown in FIG. 4, when the object to be adjusted is "No.1: air separation in tray", the pieces of related information including plain paper as the species of the sheet of paper; A4 as the sheet size; 62 g/m$^2$ as the paper weight; white as the color; vertical as the orientation profile of fibers in the sheet of paper; tray 2 as the used tray; 20 degrees C. as the temperature; 50% as humidity and 3% as printing rate are stored with them being related to the photographed data.

The database DB1 may be prepared before the image forming apparatus 100 is forwarded. The database DB1 may be formed as new one after the image forming apparatus 100 is forwarded and the contents of the formed database DB1 may be updated. For example, the database DB1 may be updated or formed so that a photograph mode for photographing the object to be adjusted is selected, the apparatus stares photographing the object to be adjusted as a trigger of the selection of this photographing mode, and the pieces of the related information are stored in the database DB1 with them being related to the photographed data Ia of the ideal state of the object to be adjusted, the photographed data la being obtained by photographing the object. Such photographing may be consecutive photographing or intermittent photographing at regular interval. A user may determine whether or not the photographed data Ia is relative to the ideal state of the object to be adjusted. The control unit 50 also may determine whether or not the photographed data Ia is relative to the ideal state of the object to be adjusted on the basis of past photographed data.

The database DB1 may be updated or formed by obtaining the photographed data Ia by photographing each object to be adjusted at a regular cycle daring the operation of the image forming apparatus 100. Specifically, when the image forming process is consecutively performed on predetermined sheets of paper (for example, 1000 sheets of paper), any failure such as a jam does not occur in the course of printing so that it is possible to determine that the image forming apparatus 100 has a normal and stable state. Accordingly, in this case, it is possible to obtain the photographed data Ia of ideal state so that the database DB1 is formed or updated by obtaining the photographed data Ia of the object to be adjusted for every time when a predetermined unit of the sheets of paper P is printed.

In this embodiment, in order to try to improve search efficiency, the pieces of the related information in the database DB1 are respectively ranked among them in influential order (higher important order) to the photographed data (image forming). FIG. 6 shows tine pieces of ranked related information. As shown in FIG. 6, pieces of rank information indicating the influence to the photographed data are added to respective pieces of the related information in the database DB1. In this embodiment, the rank information contains four ranks and they are indicated as symbols, A, B, C and D in influential order. Of course, the rank is not limited to the four ranks. The ranking may be performed when the image forming apparatus 100 is forwarded or after the image forming apparatus 100 is forwarded. The user may change the rank given when the image forming apparatus 100 is forwarded using the operation display unit 70 or the like after the image forming apparatus 100 is forwarded.

Specifically, when the object to be adjusted is "No.1: air separation in tray", pieces of the rank information including A rank as the species of the sheet of paper; B rank as the sheet size; A rank as the paper weight; C rank as the color; B rank as the orientation profile of fibers in the sheet of paper; B rank as stiffness; B rank as temperature; C rank as the printing rate are stored with them being related to the pieces of related information. Thus, when the object to be adjusted is "No.1:: air separation in tray", the pieces of related information relative to the species of the sheet of paper and the paper weight, which exert a great influence on a sheet floating capacity of the sheet of paper, are ranked as the highest A rank. When the object to be adjusted is "loop in registration rollers" or "curved transporting path", on which the sheet of paper P is subject to any deformation thereof, the pieces of related information relative to the orientation profile of fibers in the sheet of paper and the stiffness, in addition to the species of the sheet of paper and the paper weight, are ranked as the highest A rank.

FIG. 7 shows a configuration example of the database DB1 in which pieces of the highest ranked related information are extracted from the pieces of the related information in the database DB1, For example, as shown in FIG. 7, when the object to be adjusted is "No.1; air separation in tray", pieces of the related, information relative to the species of the sheet of paper and the paper weight as A rank are extracted and these pieces of the related information acre preferentially searched.

[Configuration Example of Screen During Adjustment Mode]

Figure 8:
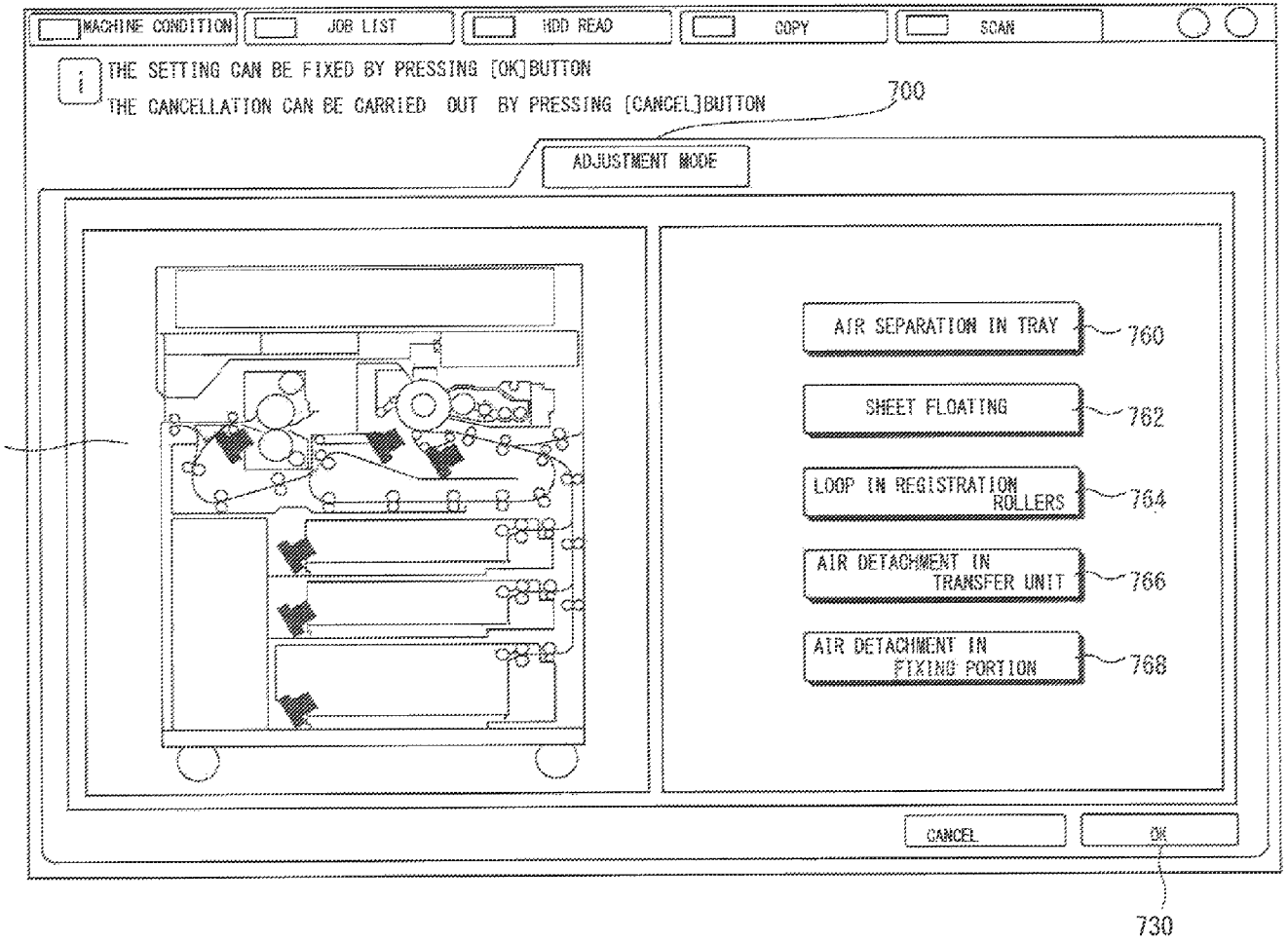
FIG. 8 is an illustration illustrating a configuration example of an adjustment object selection screen for adjustment mode.
Figure 9:
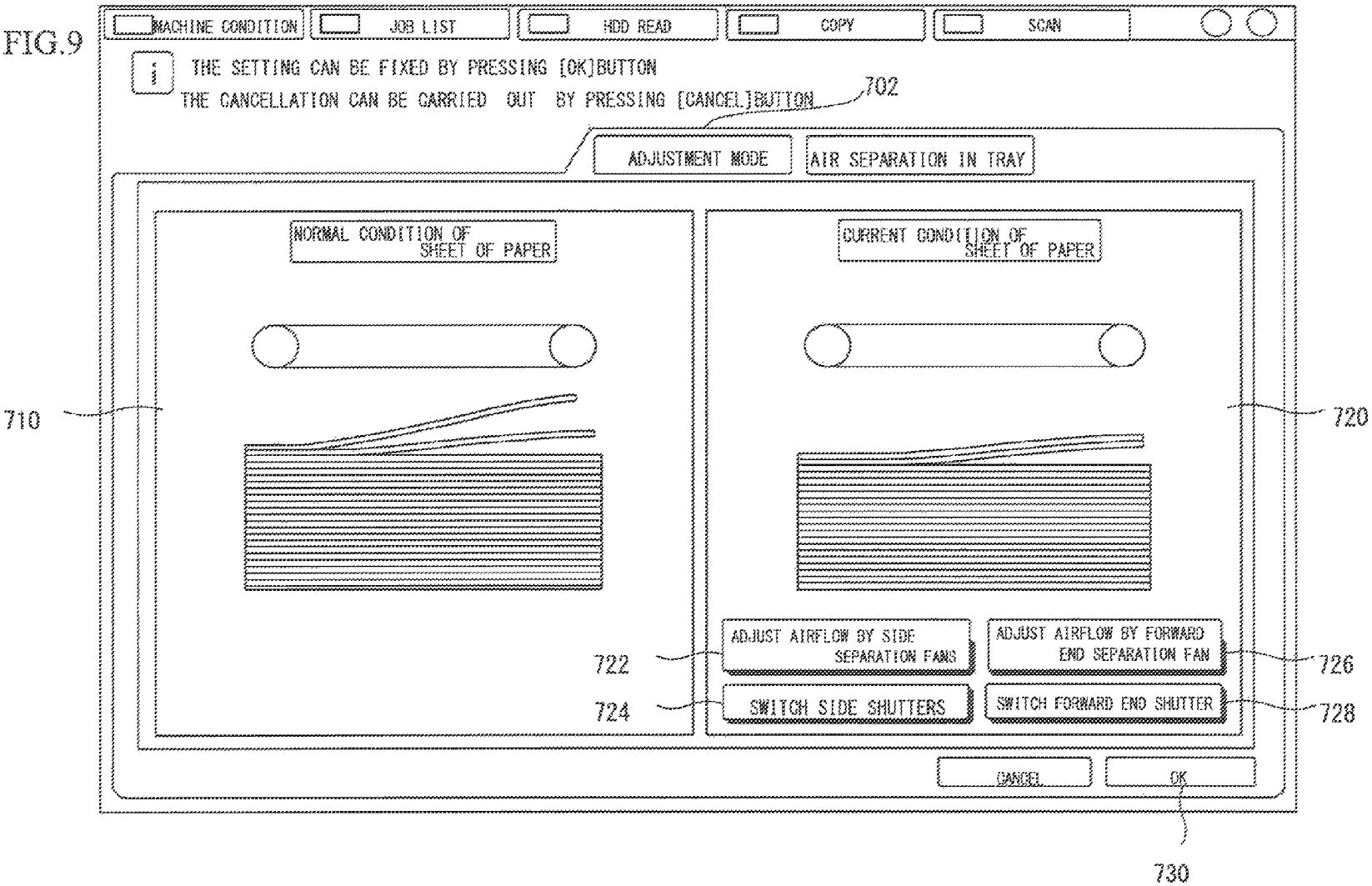
FIG. 9 is an illustration illustrating a configuration example of a comparison screen for adjustment mode.

The following will describe a configuration example of a screen represented on the operation display unit of the computer 500 and/or the operation display unit 70 of the image forming apparatus 100 when selecting the adjustment mode. FIGS. 8 and 9 illustrate configuration examples of the screens represented on the operation display unit when selecting the adjustment mode.

For example, when the user selects the adjustment mode on a menu screen (initial screen) on the operation display unit of the computer 500 or the like, as sheen in FIG. 8, the menu screen is changed to an adjustment object selection screen 700. A left sub-screen of the adjustment object selection screen 700 displays an image 750 illustrating the image forming apparatus in which each camera is positioned at each object to be adjusted such as the tray where the separation is performed. A right sub-screen of the adjustment object selection screen 700 displays buttons for selecting the object to be adjusted such as an adjustment button 750 for air separation in the tray, an adjustment button 762 tor sheet floating, an adjustment button 764 for loop in the registration rollers, an adjustment button 766 for air detachment in the transfer unit and an adjustment batten 768 for air detachment in the fixing portion.

When any one of the adjustment buttons on the right sub-screen is selected, the corresponding camera image corresponding thereto may foe highlighted on the left sub-screen. The object to be adjusted may be directly selected by selecting the camera image on the left sub-screen. Only one of the right and left screens may be displayed.

When selecting any one of the adjustment buttons in the adjustment object selection screen 700, as shown in FIG. 9, the screen is changed to a comparison screen 702 illustrating a searched result corresponding to each object to be adjusted. A case where the adjustment button 760 for air separation in the tray is selected as the adjustment button will be described later.

An ideal image (first image) 710 illustrating an ideal separation condition of the sheets of paper P searched from the database DB1 is displayed on a left side sub-screen of the comparison screen 702. A current image (second, image) 720 illustrating a current separation condition of the sheet(s) of paper P in the object to be adjusted, which is selected by the user, is displayed on a right side sub-screen of the comparison screen 702. In the current image 720, an adjustment button 722 for adjusting airflow by the side separation fans, a switching button 724 for switching the side shutters, an adjustment button 726 for adjusting airflow by the forward end separation fan and a switching button 728 for switching the forward end shutter are displayed on a lower portion thereof.

The adjustment button 722 is a button for adjusting the airflow by the side separation fans 302. The switching button 724 is a button for switching the side shutters 304. The adjustment button 726 is a button for adjusting the airflow by the forward end separation fan 306. The switching button 728 is a button for switching the forward end shutter 308.

[Operation Example of Image Forming Apparatus]

Figure 10:
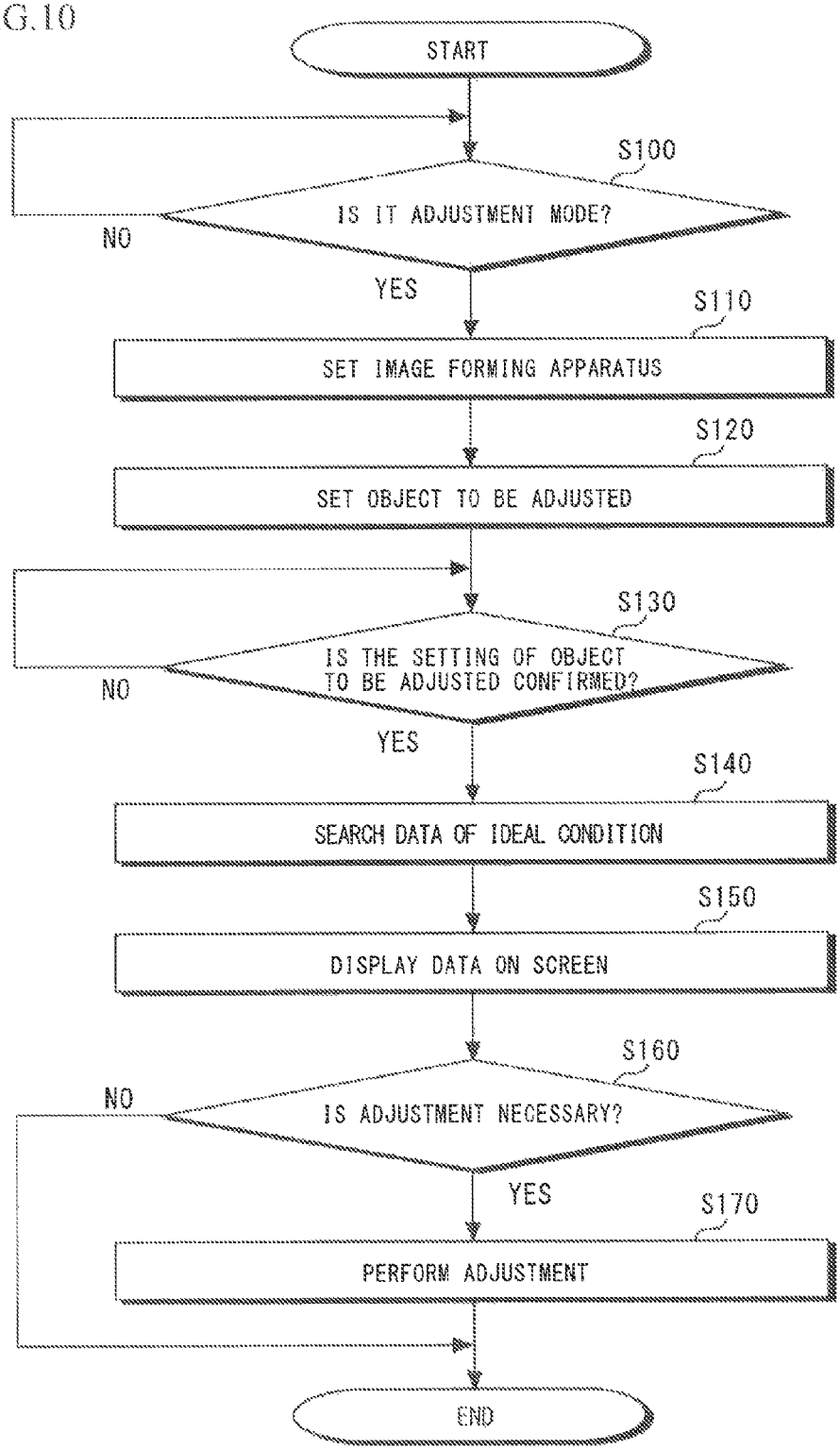
FIG. 10 is a flowchart shoving an operation example of the image forming apparatus according to the embodiment of this invention in as moment of the adjustment mode.

The following will describe an operation example of the image forming apparatus 100 carrying out the adjustment mode according to an embodiment of the invention. FIG. 10 shows the operation example of the image forming apparatus 100 according to the embodiment of this invention in a moment of the adjustment mode. It is to be noted that in the following description, a case where the air separation in the tray is adjusted as the object to be adjusted and the database DB1 is used as the database used when searching the data will be described.

As shown in FIG. 10, at a step S100, the controller 50 determines whether or not the adjustment mode is selected. For example, it is determined on the basis of a fact whether or not the user selects the adjustment mode on the operation screen of the operation display portion in the computer 500 or the operation screen of the operation display unit 70 in the image forming apparatus 100. The adjustment mode is selected when trying to correct any failure occurring in each object to be adjusted such as the air separation in the tray during operation time of the image forming apparatus 100. If it is determined that the adjustment mode is selected, then the control unit 10 goes to a step S110. If it is not determined that the adjustment mode is selected, then the control unit 50 waits until any input of the adjustment mode or the like is received.

At the step S110, the control unit 50 sets the image forming apparatus 100 so that the image forming apparatus 100 can perform any adjustment. For example, if the adjustment mode is selected, as shown in FIG. 8, the adjustment object selection screen 700 for adjustment mode is displayed on the screen. If the setting of the image forming apparatus 100 finishes, then the control unit 50 goes to a step S120.

At the step S120, the control unit 50 sets the object to be adjusted. When the adjustment button corresponding to the selected object to be adjusted is selected on the adjustment object selection screen 700, the control unit 50 selects a camera corresponding to the selected object to be adjusted, the camera photographing a current state of the selected object to be adjusted. If the object to be adjusted is selected, then the control unit 50 goes to a step S130.

At the step S130, the control unit 50 determines whether or not the user confirms the selected object to be adjusted. For example, it is determined on the basis of a fact whether or not the user selects OK button 730 indicating the confirmation on the adjustment object selection screen 700 shown in FIG. 8. If the control unit 50 determines that the user confirms the setting, then the control unit 50 controls the camera corresponding to the selected object to be adjusted to start photographing the current state of the object to be adjusted and stores the items of photographed data Ib in the storage unit 80 with them being related to the pieces of related information relative to the image forming. If the current state of the object to be adjusted is photographed, then the control unit 50 goes to a step S140. If the control unit 50 does not determine that the user confirms the setting, then the control unit 50 waits until the user confirms the setting.

It is to be noted that the items of photographed data Ib of the current object to be adjusted may be those before the adjustment mode is selected. They may be those obtained by photographing the object when any failure occurs during the operation of the image forming apparatus 100. In this case, a list of a job history related to the items of photographed data Ib obtained by photographing the object during the operation of the image forming apparatus 100 may be displayed on, for example, the operation screen and the items of photographed data Ib of current object to be adjusted may be selected from the list of the job history.

At the step S140, the control unit 50 searches from the database Db1 the photographed data Ia of the object to be adjusted in the ideal state thereof, name of the object to be adjusted and the pieces of the related information of which are identical with the name of the object to be adjusted and the pieces of the related information of the items of photographed data Ib of current object to be adjusted, which is selected on the screen. The control portion 50 preferentially searches the higher ranked related information relative to the photographed data Ia and determines whether or not the pieces of preferentially searched higher ranked related information of the correct photographed data Ib are identical with the pieces of preferentially searched higher ranked related information of the ideal photographed data Ia.

here, the following will describe a case where the air separation in the tray is adjusted. FIG. 11A shows the photographed data Ib relative to the current air separation in the tray. FIG. 11B shows the items of photographed data Ia relative to the air separation in the tray searched among the items of photographed data Ia relative to the air separation in the tray of ideal state, which are stored in the database DB1.

When the object to be adjusted is the air separation in the tray, the control unit 50 extracts items No. 1, No. 2 and No.5 of the air separation in the tray, which relates to the same object, to be adjusted, from the database DB1 as shown in FIG. 11B. Next, the pieces of related information relative to the species of the sheet of paper and the paper weight are preferentially searched among the plural pieces of the related information. Accordingly, the control unit 50 searches item(s) of the photographed data Ia of the object to be adjusted in the ideal state thereof, which has (have) a piece of the related, information that agrees with the piece of the related information relative to the species of sheet of paper including thick paper in the items of photographed data Ib of current object to be adjusted, and extracts the items No.2 and No.5 of the air separation in the tray, which agree with the piece of the related information relative to the species of sheet of paper including thick paper. Further, the control unit 50 searches item(s) of the photographed data Ia of the object to be adjusted in the ideal state thereof, which has (have) a piece of the related information that agrees with the piece of the related information relative to the paper weight including 350 g/m$^2$ in the items of photographed data Ib of current object to be adjusted, and extracts the photographed data Ia relative to the item No. 5 of the air separation in the tray, which agree with the piece of the related information relative to the paper weight including 350 g/m$^2$.

When contents of the related information include a numerical value in a case of searching, the control unit 50 may perform the search with the numerical value having a predetermined scope thereof (being increased). For example, when the paper weight in the items of photographed, data Ib of current object to be adjusted is 350 g/m$^2$, an extent of the paper weight in the database DB1 to be searched is set so as to be 348 g/m$^2$ to 352 g/m$^2$. Thus, it is possible to determine that even if the paper weight in the photographed data Ia of the object to be adjusted in the ideal state thereof in the database DB1 does not completely agree with the paper weight in the photographed data Ib of current object to be adjusted, it is possible to determine that both agree with each other when the numerical value of the paper weight in the photographed data Ib of current object to be adjusted stands within the extent. Thus, it is possible to extend a search extent and to enhance search effectiveness. Accordingly, this is specifically valid in. a case where there is a small quantity of data in the database DB1.

It is to be noted that when there is no related information, which agrees with the related information of the photographed data Ib of current object to be adjusted, in the pieces of the A ranked related information in the photographed data Ia of the object to be adjusted in the ideal state thereof in the database DB1, the control unit 50 searches the pieces of the B ranked related information in the photographed data Ia of the object to be adjusted in the ideal state thereof in the database DB1, which agrees with the related information of the photographed data Ib of current object to be adjusted. When there is no related information in the B ranked related information, the control, unit 50 searches the pieces of the C ranked related information in the photographed data Ia of the object to be adjusted, in the ideal state thereof in the database DB1, which agrees with the related information of the photographed data Ib of current object to be adjusted. Thus, when there is no related information, which agrees with, the related information of the photographed data Ib of current object to be adjusted, in the higher ranked related information in the photographed data Ia, the control unit 50 searches the lower ranked related information.

At the step S150, the control unit 50 controls the operation display unit of the computer 500 or the like to display the photographed data Ia of the object to be adjusted in the ideal state thereof searched from the database DB1 and the photographed data Ib of current object to be adjusted on its screen side by side. Specifically, as shown in FIG. 9, the ideal image 710 illustrating the photographed data Ia of the object to be adjusted in the ideal state thereof searched from the database DB1 is displayed on a left side sub-screen of the comparison screen 702 on the display portion of the computer 500. The current image 720 illustrating the photographed data Ib of current object to be adjusted is displayed on a right side sub-screen of the comparison screen 702. When displaying both images on the sub-screens of the comparison screen 702, the control unit 50 goes to a step S160.

At the step S160, the control unit 50 determines whether or not the adjustment is set. If it is determined that when a failure occurs and any adjustment is necessary by comparing the images with each other in the sub-screens of the comparison screen 702, then the control unit 50 goes to a step S170. On the other hand, if it is determined that the photographed data Ib of current object to be adjusted is normal, then the control unit 50 finishes a series of processing in the adjustment mode because any adjustment is not necessary.

At the step S170, the control unit 50 performs the adjustment on the object to be adjusted. Specifically, by operating each species of adjustment buttons displayed on the comparison screen 702 shown in FIG. 9, each parameter corresponding to each object to be adjusted is set. For example, when adjusting the air separation in the tray, the control unit 50 determines whether or not any one of the adjustment button 722 tor adjusting airflow by the side separation fans, the switching button 724 for switching the side shutters, the adjustment button 726 for adjusting airflow by the forward end separation fan and the switching button 728 for switching the forward end shutter is selected or pressed down on the comparison screen 702 in the adjustment mode. If any one of these buttons is selected, the control unit 50 carries out the adjustment corresponding to the selected button. For example, when selecting the adjustment button 722 for adjusting airflow by the side separation fans, the control unit 50 adjusts the revolution number of the side separation fans 302 to adjust their airflows. If the adjustment finishes, then the control unit 50 finishes the series of processing in the adjustment mode.

As described above, according to the embodiments, the pieces of the related information are ranked for every object to be adjusted and a piece of the higher ranked related information is preferentially searched so that it is possible to easily and rapidly search the photographed data Ia of the object to be adjusted in the ideal state thereof which agrees with the photographed data Ib of current object to be adjusted from the many items of the photographed data Ia stored in the database DB1 or DB2, Accordingly, it is possible to save labor based on reduction of the adjustment time and to reduce downtime. It is also possible to adjust the object to be adjusted with ease and to improve efficiency in an analysis of failure.

In the past, when searching the photographed data agreeing with an object among the database including prepared enormous items of photographed data Ia, the search could not be success if even one piece of the related information was different therefrom. On the other hand, according to the embodiments, the search can be success if the higher ranked related information agrees therewith so that it is possible to improve the search effectiveness.

According to the embodiments, the pieces of the related information are ranked on the basis of importance for every object to be adjusted so that if only the higher ranked related information as used for search, it is possible to search the photographed data Ia agreeing with the object.

This invention is not limited to the above-mentioned embodiments and a modification in which any kinds of changes are added to the above-mentioned embodiments may be included in the invention insofar as they are within the scope of the invention. For example, the database DB1 may be stored in a memory installed in the computer 500. The computer 500 may operate she adjustment mode or the operation display unit 70 of the image forming apparatus 100 may operate the adjustment mode. Although the sheet feeder 30 of the image forming apparatus 100 has fed the sheet of paper P in the above-mentioned embodiments, a large capacity feeder may be provided at upstream side of the image forming apparatus 100 along the sheet feeding direction and may feed the sheet of paper P to the image forming apparatus 100.

If should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus comprising:

a photographing portion that photographs an object to be adjusted in the image forming apparatus and obtains first photographed information with a plurality of pieces of related information with reference to image forming being related to the first photographed information; and a control portion that is configured to search second photographed information indicating an ideal condition for each object to be adjusted, related information of the second photographed information agreeing with the related information of the first photographed information obtained by the photographing portion, from a database in which the second photographed information is stored with a plurality of pieces of ranked related information with reference to the image forming being related to the second photographed information, wherein the control portion preferentially searches the higher ranked related information among the plurality of pieces of the ranked related information that is related to the second photographed information at a moment of searching the second photographed information.

2. The image forming apparatus according to claim 1 wherein when the related information includes a numerical value, the control portion searches the second photographed information with the numerical value having a predetermined scope thereof.

3. The image forming apparatus according to claim 1 further comprising a display portion which displays on a screen a first image based on the first photographed information photographed by the photographing portion and a second image based on the second photographed information searched from the database by the control portion.

4. The image forming apparatus according to claim 3 wherein the control portion controls the display portion to display on the screen thereof an adjustment image for adjusting an object to be adjusted corresponding to the first image.

5. The image forming apparatus according to claim 1 wherein the object to be adjusted includes at least one of a floating or separating condition of sheets of paper in a feeding tray, a loop-shaped condition of a sheet of paper in registration rollers, and a detached condition of a sheet of paper relative to a transfer unit or a fixing portion.

6. The image forming apparatus according to claim 5 wherein rankings of the ranked related information are different for each of the floating or separating condition of sheets of paper in a feeding tray, the loop-shaped condition of a sheet of paper in registration rollers, and the detached condition of a sheet of paper relative to a transfer unit or a fixing portion.

7. An image forming method comprising the steps of:

a first step of photographing an object to be adjusted in an image forming apparatus and obtaining first photographed information with a plurality of pieces of related information with reference to mage forming being related to the first photographed information; and a second step of searching second photographed information indicating an ideal condition for each object to be adjusted, related information of the second photographed information agreeing with the related information of the first photographed information obtained by the photographing portion, from a database in which the second photographed information is stored with a plurality of pieces of ranked related information with reference to the image forming being related to the second photographed information, wherein the higher ranked related information is preferentially searched among the plurality of pieces of the ranked related information that is related to the second photographed information at a moment of searching the second photographed information in the second step.

8. he image forming method according to claim 7 wherein the object to be adjusted includes at least one of a floating or separating condition of sheets of paper in a feeding tray, a loop-shaped condition of a sheet of paper in registration rollers, and a detached condition of a sheet of paper relative to a transfer unit or a fixing portion.

9. The image forming method according to claim 8 wherein rankings of the ranked related information are different for each of the floating or separating condition of sheets of paper in a feeding tray, the loop-shaped condition of a sheet of paper in registration rollers, and the detached condition of a sheet of paper relative to a transfer unit or a fixing portion.

* * * * *